US008176865B2

(12) United States Patent
Zanfei

(10) Patent No.: US 8,176,865 B2
(45) Date of Patent: May 15, 2012

(54) STEERING ACTUATOR FOR A STEER-BY-WIRE SHIP'S CONTROL SYSTEM AND METHOD FOR OPERATING SAID STEERING ACTUATOR

(75) Inventor: Adriano Zanfei, Madrano (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 127 days.

(21) Appl. No.: 12/680,624

(22) PCT Filed: Sep. 26, 2008

(86) PCT No.: PCT/EP2008/062894

§ 371 (c)(1),
(2), (4) Date: Mar. 29, 2010

(87) PCT Pub. No.: WO2009/047131

PCT Pub. Date: Apr. 16, 2009

(65) Prior Publication Data

US 2010/0212568 A1 Aug. 26, 2010

(30) Foreign Application Priority Data

Oct. 5, 2007 (DE) ..... 10 2007 048 061

(51) Int. Cl.
*B63H 25/24* (2006.01)

(52) U.S. Cl. ..... 114/144 RE; 114/146

(58) Field of Classification Search ..... 114/144 R, 114/144 RE, 146

See application file for complete search history.

(56) References Cited

U.S. PATENT DOCUMENTS

| | | | | |
|---|---|---|---|---|
| 3,774,568 | A | 11/1973 | Borst et al. | |
| 4,225,148 | A | 9/1980 | Andersson | |
| 4,531,427 | A | 7/1985 | Nilsson | |
| 4,544,362 | A | 10/1985 | Arneson | |
| 4,645,463 | A | 2/1987 | Arneson | |
| 4,891,994 | A * | 1/1990 | Barba | 74/2 |
| 4,931,025 | A | 6/1990 | Torigai et al. | |
| 4,939,660 | A | 7/1990 | Newman et al. | |
| 5,118,315 | A | 6/1992 | Funami et al. | |
| 5,167,546 | A | 12/1992 | Whipple | |
| 5,169,348 | A | 12/1992 | Ogiwara et al. | |
| 5,203,727 | A | 4/1993 | Fukui | |
| 5,326,294 | A | 7/1994 | Schoell | |
| 5,385,110 | A | 1/1995 | Bennett et al. | |
| 5,426,354 | A * | 6/1995 | Bausch | 318/400.04 |
| 5,549,493 | A | 8/1996 | Bezzi | |
| 5,647,780 | A | 7/1997 | Hosoi | |
| 5,785,562 | A | 7/1998 | Nestvall | |
| 6,431,928 | B1 | 8/2002 | Aarnivuo | |
| 6,726,511 | B1 | 4/2004 | Schelman | |
| 6,843,195 | B2 | 1/2005 | Watabe et al. | |
| 6,899,196 | B2 | 5/2005 | Husain et al. | |
| 6,908,350 | B1 | 6/2005 | Roessler et al. | |
| 7,036,445 | B2 * | 5/2006 | Kaufmann et al. | 114/144 RE |
| 7,137,347 | B2 * | 11/2006 | Wong et al. | 114/144 RE |
| 7,258,072 | B2 * | 8/2007 | Wong et al. | 114/146 |
| 7,295,905 | B2 | 11/2007 | Yao et al. | |
| 7,568,549 | B2 | 8/2009 | Wun et al. | |
| 2004/0139903 | A1 | 7/2004 | Watabe et al. | |
| 2005/0170712 | A1 | 8/2005 | Okuyama | |
| 2006/0042532 | A1 | 3/2006 | Wong et al. | |
| 2007/0068438 | A1 | 3/2007 | Mizutani | |

FOREIGN PATENT DOCUMENTS

DE 569 396 1/1933

(Continued)

*Primary Examiner* — Lars A Olson

(74) *Attorney, Agent, or Firm* — Davis & Bujold, P.L.L.C.

(57) ABSTRACT

A steering actuator (1) designed as a linear electro-mechanical actuator for a ship control system which comprises an electric motor (2), a controller (11) connected, via a CAN bus, to the electronic control unit of the ship control system (ECU) and an angle sensor (12) actively connected to the controller (11) for determining the angular position of the rudder (13). The electric motor (2) is designed as a vector-controlled brushless motor.

19 Claims, 3 Drawing Sheets

FOREIGN PATENT DOCUMENTS

| | | | |
|---|---|---|---|
| DE | 31 30 518 | A1 | 4/1982 |
| DE | 42 13 561 | A1 | 10/1992 |
| DE | 101 58 870 | A1 | 5/2003 |
| DE | 10 2004 050 014 | A1 | 6/2005 |
| DE | 10 2005 036 686 | A1 | 12/2005 |
| DE | 699 22 397 | T2 | 12/2005 |
| DE | 11 2004 001 258 | T5 | 10/2006 |
| EP | 0 102 579 | A2 | 3/1984 |
| EP | 1 770 008 | A2 | 4/2007 |
| EP | 1 792 802 | A2 | 6/2007 |
| JP | 2-279495 | A | 11/1990 |
| WO | 99/22989 | A1 | 5/1999 |

* cited by examiner

STEERING ACTUATOR FOR A STEER-BY-WIRE SHIP'S CONTROL SYSTEM AND METHOD FOR OPERATING SAID STEERING ACTUATOR

This application is a National Stage completion of PCT/EP2008/062894 filed Sep. 26, 2008, which claims priority from German patent application serial no. 10 2007 048 061.1 filed Oct. 5, 2007.

FIELD OF THE INVENTION

The present invention relates to a steering actuator for a steer-by-wire ship's control system. Furthermore, the invention relates to methods for operating the steering actuator.

BACKGROUND OF THE INVENTION

From the prior art, steer-by-wire systems are known, which are also used in ship control technology. In such systems the steering commands given by a steering unit are detected by a sensor and transmitted by a control unit to a steering actuator which carries out the steering command. Advantageously, there is no mechanical connection between the helm and the rudder, or in the case of a motor vehicle, between the steering-wheel and the steered wheels.

In ship control technology the steering units connected to the rudder are usually hydraulically actuated, which results disadvantageously in poor dynamics and high maintenance costs. In addition steer-by-wire ship's control systems are known, in which the steering actuator is an electro-mechanical actuator in the form of a ball-screw spindle by means of which rotational movement of the one electric motor is converted by the ball-screw spindle into a translational movement for actuating the rudder.

This use of an electric motor driven ball-screw spindle as the steering actuator has the drawback that the adjustment speed and dynamics of the actuator are low; furthermore, ball-screw spindles are not self-locking, especially when the forces acting are large.

For example, a steer-by-wire ship's control system is known from U.S. Pat. No. 6,431,928 B1. In this known system an electric motor is provided for rotating the entire propeller-drive unit by means of a mechanical energy transfer chain, the electric motor being controlled by a control unit connected on the one hand to the steering device to obtain steering command information, and on the other hand to a sensor which detects the steering setting information.

From EP 1770008 A2 a steer-by-wire ship's control system is known, which comprises at least two steering units. In this case the rudder is actuated by means of an actuator which can be operated hydraulically with reference to the steering signals generated by whichever steering unit demands the more rapid movement of the rudder. In the known system the steering units each have a rudder, each of which is connected to a control device which, in turn, is connected to the control network.

SUMMARY OF THE INVENTION

The purpose of the present invention is to provide a steering actuator for a steer-by-wire ship's control system, which is of compact structure and can be produced in a favorable manner. Furthermore, the steering actuator must be largely self-locking and must have a good dynamic performance. In addition, a method for operating the steering actuator is indicated.

Accordingly, a steering actuator for a steer-by-wire ship's control system is proposed, which is designed as a linear electro-mechanical actuator comprising an electric motor designed as a vector-controlled brushless motor.

The design of the electric motor as a vector-controlled brushless motor enables sinusoidal or trapezium-shaped signal conversion whereby direct-current or alternating-current motors can be used. Furthermore, owing to the vector control the motor power can be doubled for approximately 5 seconds, corresponding to a 100% overload. The dynamics are also optimized since the vector control enables very high accelerations compared with a conventional electric motor.

In a first preferred embodiment of the invention the steering actuator is designed as an electric motor powered geared spindle drive whose threaded spindle, which is articulated to the tiller or to a suitable part of the rudder mechanism, has an outer thread which engages with the inner thread of a screw nut driven by the electric motor.

Alternatively, the threaded spindle can be hollow-bored and have an inner thread, in which the outer thread of a screw driven by the electric motor engages.

In a particularly advantageous further development of the invention the screw nut is formed by the rotor of the electric motor.

Thanks to the conversion, according to the invention, of the rotary movement of the electric motor into a translational movement of the threaded spindle by virtue of the cooperation of an inner thread with an outer thread, desired self-locking is achieved in an advantageous manner, so that when the rudder is not actuated the electric motor consumes very little current.

To enable maneuverability in the event that the electric motor should fail, it is also proposed to fix one end of a Bowden cable detachable to the end of the steering actuator remote from the threaded spindle, to the screw nut or to the rotor of the electric motor, so that by actuating (rotating) the Bowden cable by means of a suitable device, for example by means of a crank, the threaded spindle can be moved.

Advantageously, the end of the Bowden cable remote from the rotor can be connected in a rotationally fixed manner by means of an adaptor device to the shaft connected in a rotationally fixed manner to the rudder, so that the Bowden cable can be actuated by actuating the rudder.

According to the invention, to control the steering actuator a controller is provided, which is connected via the CAN bus to the electronic control unit of the ship's control system ECU; to determine the angular position of the rudder an angle sensor is provided, which is preferably designed as an incremental emitter and determines the rotation of the rotor of the electric motor or that of the threaded spindle. The ECU processes the signals of the steering unit actuated by the user or of an auto-pilot device and passes them on to the steering actuator. In this way the steering actuator is operated in accordance with the specifications of the steering unit and the ECU in relation to the steering angle and the turning speed of the rudder.

According to the invention, two rudders can be actuated by one steering actuator and for that purpose the spindle is connected to both tillers via an intermediate component. According to the invention a steering actuator can also be provided for each rudder, so that the rudders can be actuated independently of one another with reference to commands from the ECU. This can be an advantage, for example, when carrying out complex maneuvers.

BRIEF DESCRIPTION OF THE DRAWINGS

Below, the steering actuator according to the invention and methods for its operation are described in more detail as examples with reference to the attached figures, which show.

DETAILED DESCRIPTION OF THE PREFERRED EMBODIMENTS

Figure 1:
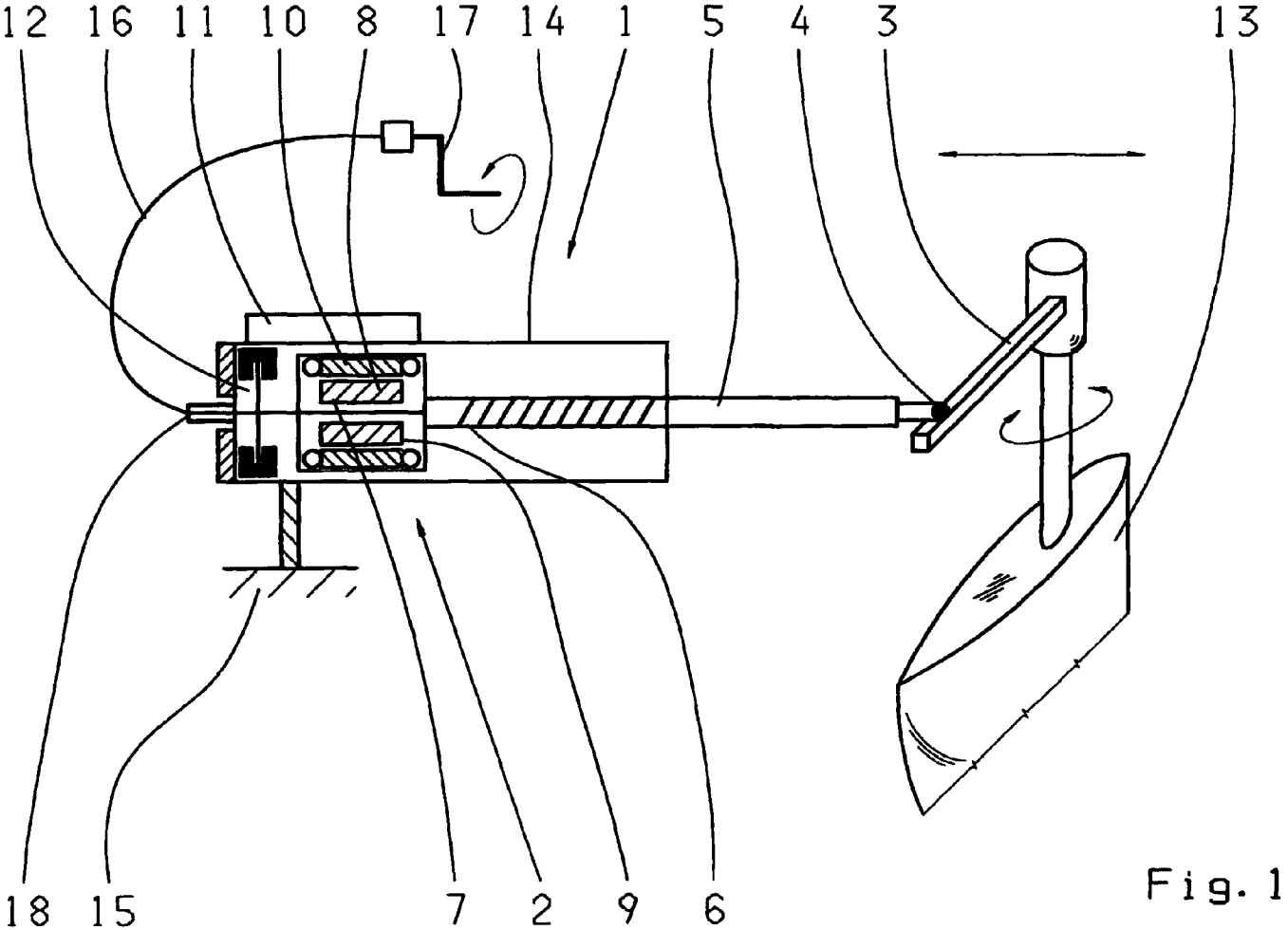
FIG. 1: Schematic sectional view of a preferred embodiment of a steering actuator according to the invention.

FIG. 1 shows a first embodiment of a steering actuator 1 according to the invention. The steering actuator 1 is in the form of a linear electro-mechanical actuator and comprises an electric motor 2 designed as a vector-controlled brushless motor.

In the example shown in FIG. 1 the steering actuator 1 is in the form of an electric motor powered geared spindle drive whose threaded spindle 5, which is connected to the tiller 3 by an articulation 4 preferably in the form of a ball joint, has an outer thread 6 which engages in the inner thread 7 of a screw nut 8 driven by the electric motor 2. In the example shown in FIG. 1 the screw nut 8 is formed by the rotor 9 of the electric motor; in the figure the stator is indexed 10 and is in the form of a permanent magnet fixed on the housing.

By virtue of the active connection between the outer and inner threads and the multiple points of contact between the two components, the advantage is obtained that high torques can be transferred even with a compact structure and high accelerations and speed values can be achieved. For example, with the actuator according to the invention up to 7000 r/min are possible, whereas with an actuator having a conventional ball-screw spindle up to 2500 r/min can be obtained. The number of contact points between the two components, the spindle and the screw nut (see FIG. 2) corresponds to the number of turns of the screw nut or screw. Preferably, the number of turns is larger than four. By comparison, a conventional ball-screw spindle has only two contact points.

To control the steering actuator 1 a controller 11 is provided, which is connected via the CAN bus to the electronic control unit of the ship's control system ECU. In addition, to determine the angular position of the rudder an angle sensor 12 is connected to the controller 11, which is preferably designed as an incremental emitter and which determines the angular position of the rotor 9 of the electric motor 2 or that of the threaded spindle 5.

As indicated in FIG. 1, in the example illustrated the threaded spindle 5 is guided by the rotor 9, i.e. by the screw nut 8, in the direction toward the end of the housing 14 remote from the rudder 13, which makes it possible to arrange the sensor 12 on the side of the electric motor facing away from the rudder 13, such that in this case the size of the incremental emitter enables the angular position of the spindle top be determined regardless of its axial displacement.

However, it is also possible for the sensor 12 to be arranged on the side of the electric motor facing toward the rudder 13. In the example shown in FIG. 1 the electric motor 2, the geared spindle drive and the sensor 12 are arranged in a common housing 14 fixed to the hull 15 of the ship.

To enable maneuverability in the event that the electric motor should fail, in any embodiment a Bowden cable 16 can optionally be provided, which can be connected detachably at the end of the steering actuator 1 remote from the rudder 13 to the screw nut or to the rotor 9 of the electric motor, so that the threaded spindle 5 can be moved by turning the Bowden cable by means of a crank 17. To enable the Bowden cable 16 to be connected to the rotor 9, an opening 18 is provided in the housing 14, which can preferably be closed when not in use.

Figure 2:
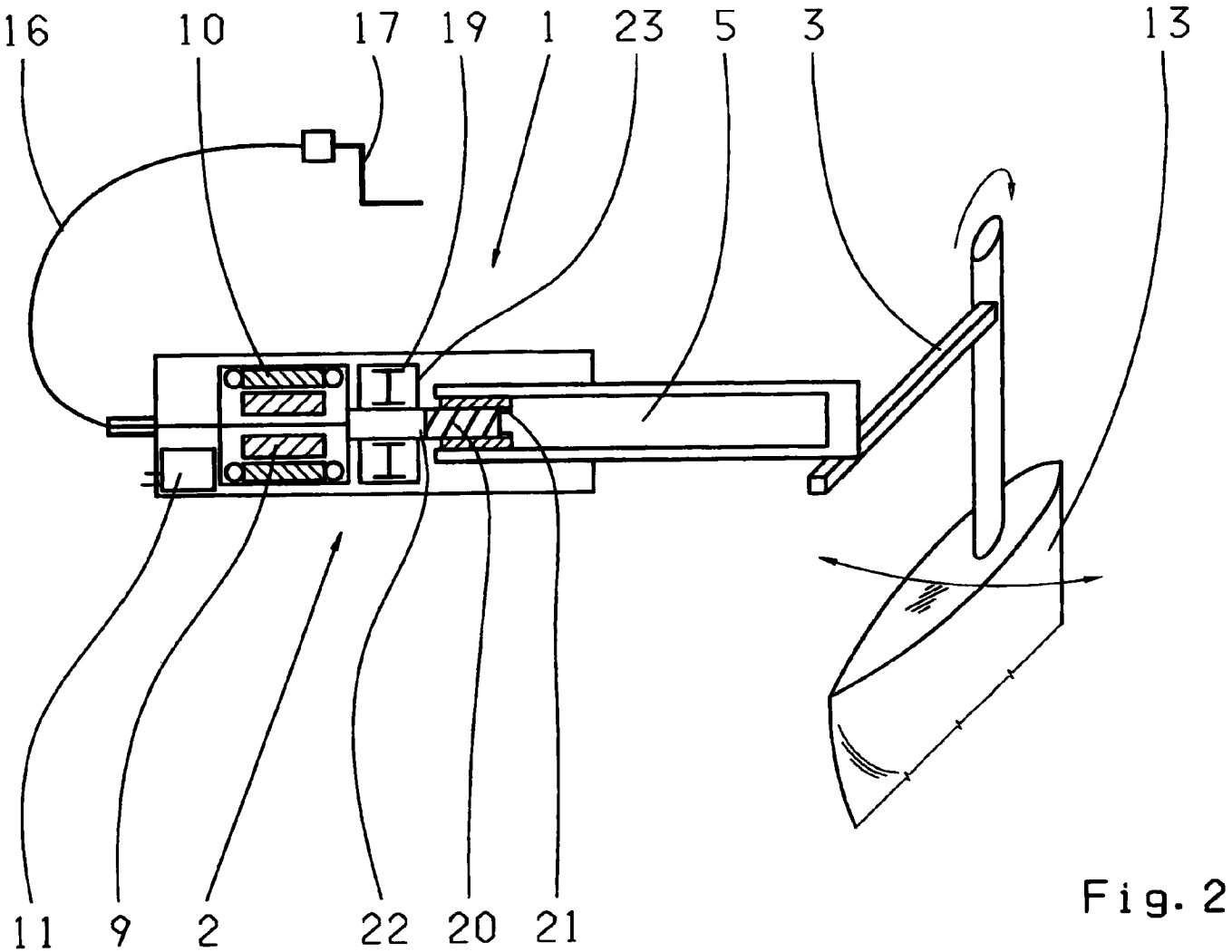
FIG. 2: Schematic sectional view of another embodiment of a steering actuator according to the invention.

FIG. 2 shows another embodiment of a steering actuator according to the invention. The difference from the embodiment according to FIG. 1 is that the threaded spindle 5 is hollow-bored and has an inner thread 21, in which the outer thread 20 of a screw 22 driven by the rotor 9 of the electric motor 2 engages; in the example illustrated a planetary transmission 19 is in addition arranged in the force flow direction between the rotor 9 of the electric motor 2 and the screw 22, which is designed as a step-down transmission so that the electric motor 2 can be made smaller. Advantageously, torsional vibrations and bending moments are partially absorbed by the housing 23 of the planetary transmission 19.

Figure 3:
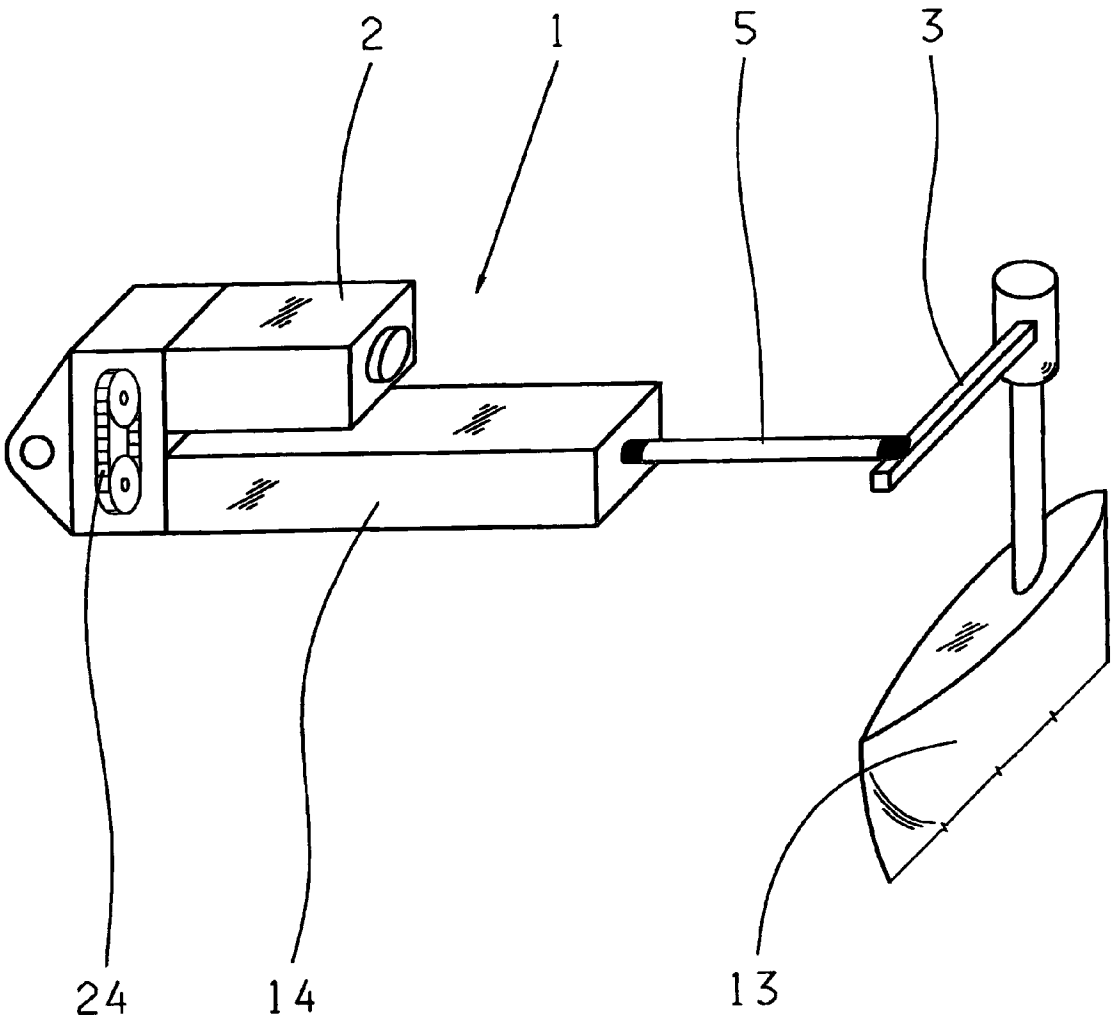
FIG. 3: Schematic sectional view of a further embodiment of a steering actuator according to the invention.

In the example shown in FIG. 3 the electric motor 2 is arranged outside the housing 14 of the steering actuator 1, so the torque from the rotor of the electric motor is transmitted to the screw nut 8 (see FIG. 1) or to the screw 22 or the planetary transmission 19 (see FIG. 2) by means of a spur gear stage or a belt drive 24.

The sensor 12 for detecting the angular position of the rudder is advantageously designed as an incremental emitter, which results in lower cost. Since an incremental emitter does not deliver an absolute value, each time the ship's control system is started up the null position (the straight-ahead position) has to be determined and the rudder brought to that position.

According to the invention, the null position is determined, when the ship's control system is started up, by operating the electric motor at a specified constant speed in one direction until the end position corresponding to that steering direction has been reached, and then storing the sensor value for that position in the controller 11.

Then, the electric motor 2 of the steering actuator is operated at a specified speed in the opposite direction until the second end position of the rudder has been reached, and the sensor value corresponding to this second end position is used in order to determine the null position with reference to the number of increments between the two end positions (it will correspond to half the incremental difference), and the rudder is finally brought to that position by actuating the electric motor is the appropriate direction. If the two end positions do not have the same angular separation from the null position, this is taken into account when determining the null position from the increments.

The end positions can preferably be determined by recognizing as an end position a point where the current taken up by the electric motor exceeds a specified threshold value. At such points the current needed by the motor operated at constant speed increases in order to overcome the "obstacle".

According to the invention, before determining the null position it is optionally checked whether the connection between the incremental emitter and the controller is functioning properly and whether the CAN is ready to operate. If this is not the case, the rudder is locked and an error message is emitted.

In addition, during the operation of the ship's control system, at specified time intervals the functionality of the CAN is checked, and for this purpose a defined signal is sent by the electronic control unit of the ship's control system ECU to the controller 11. If this signal is received without error by the controller within a specified time interval the operation of the steering actuator is continued, but if the signal is not received, or contains an error, then the controller 11 brings the rudder to the null position and holds it in that position, and an error message is emitted.

According to a variant of the method, if the signal is not received within the specified time interval or contains an error, the electronic control unit of the ship's control system ECU is requested again by the controller 11 to transmit the signal, and this can be repeated up to n times (n is a specified whole number with a value between 2 and 50). If the signal has not been received within the specified time interval or is received erroneously after the n-th repetition, then the controller 11 brings the rudder to the null position and holds it in that position, and an error message is emitted.

Indexes

1 Steering actuator
2 Electric motor
3 Tiller
4 Articulation
5 Threaded spindle
6 Outer thread
7 Inner thread
8 Screw nut
9 Rotor
10 Stator
11 Controller
12 Sensor
13 Rudder
14 Housing
15 Ship's hull
16 Bowden cable
17 Crank
18 Opening
19 Planetary transmission
20 Outer thread
21 Inner thread
22 Screw
23 Housing
24 Belt drive

The invention claimed is:

1. A steering actuator for a steer-by-wire control system of a ship, the actuator being a linear electro-mechanical actuator and comprising:

an electric motor (2), a spindle (5) connected, via an articulation (4), to a rudder assembly (3, 13), the spindle (5) comprises threads which engage threads of a threaded element (8, 22) that is driven by the electric motor (2), a controller (11) connected via a CAN bus to an electronic control unit of the control system (ECU) of the ship, an angle sensor (12) connected to the controller (11) for determining an angular position of a rudder (13), and the electric motor (2) being a vector-controlled brushless motor.

2. The steering actuator for a steer-by-wire control system of a ship according to claim 1, wherein the electric motor (2) is one of a direct-current or an alternating-current motor.

3. The steering actuator for a steer-by-wire control system of a ship according to claim 1, wherein the steering actuator is an electric motor powered geared spindle drive, and the threaded spindle (5) has an outer thread (6) which engages with a inner thread (7) of a screw nut (8) driven by the electric motor (2).

4. The steering actuator for a steer-by-wire control system of a ship according to claim 3, wherein the screw nut (8) is formed by a rotor (9) of the electric motor.

5. The steering actuator for a steer-by-wire control system of a ship according to claim 1, wherein the steering actuator is an electric motor powered geared spindle drive, and the threaded spindle (5) is hollow-bored and has an inner thread (21), in which an outer thread (20) of a screw (22), which is driven by the rotor (9) of the electric motor (2), engages.

6. The steering actuator for a steer-by-wire control system of a ship according to claim 5, wherein a planetary transmission (19), designed as a step-down transmission, is arranged in a force flow direction between the rotor (9) of the electric motor (2) and the screw (22).

7. The steering actuator for a steer-by-wire control system of a ship according to claim 3, wherein the electric motor (2), the spindle drive and the sensor (12) are arranged in a housing (14) which is fixed to a hull of the ship.

8. The steering actuator for a steer-by-wire control system of a ship according to claim 7, wherein the electric motor (2) is arranged outside the housing (14) of the steering actuator (1), and torque from the rotor (9) of the electric motor (2) is transferred to one of the screw nut (8), a screw (22) and a planetary transmission (19) by one of a spur gear stage and a belt drive (24).

9. A steering actuator for a steer-by-wire control system of a ship, the actuator being a linear electro-mechanical actuator and comprising:

an electric motor (2) comprising a rotor (9) which is coupled to a threaded element (8, 22);

a threaded spindle (5) engages the threaded element (8, 22) such that the threaded spindle (5) is axially biased by rotation of the threaded element (8, 22) the threaded spindle (5) is connected, via an articulation (4), to a rudder assembly (3, 13);

a controller (11) connected, via a CAN bus, to an electronic control unit of the control system (ECU) of the ship;

an angle sensor (12) connected to the controller (11) for determining an angular position of a rudder (13);

the electric motor (2) being a vector-controlled brushless motor; and the angle sensor (12) is an incremental emitter which detects an angular position of at least one of the rotor (9) of the electric motor (2) and an angular position of the threaded spindle (5).

10. The steering actuator for a steer-by-wire control system of a ship according to claim 9, wherein the threaded spindle (5) has an outer thread (6) which engages in the inner thread (7) of a screw nut (8) driven by the electric motor (2), or of the rotor (9), the threaded spindle (5) is guided by the rotor (9) or by the screw nut (8) in a direction toward an end of the housing (14) remote from the rudder (13), the incremental emitter (12) is arranged on the side of the electric motor (2) facing away from the rudder (13), and the incremental emitter (12) is sized such that detection of the angular position of the spindle (5) is ensured regardless of its axial displacement.

11. The steering actuator for a steer-by-wire control system of a ship according to claim 9, wherein the incremental emitter (12) is arranged on a side of the electric motor (2) facing toward the rudder (13).

12. The steering actuator for a steer-by-wire control system of a ship according to claim 1, wherein a Bowden cable (16) is detachably connected to a rotor (9) of the electric motor (2), at an end of the steering actuator (1) remote from the rudder (13), so that the threaded spindle (5) is moved by turning the Bowden cable (16), and an opening (18) is provided in a housing (14) to enable connection of the Bowden cable (16) to the rotor (9).

13. The steering actuator for a steer-by-wire control system of a ship according to claim 12, wherein the Bowden cable (16) is actuated by a crank (17).

14. The steering actuator for a steer-by-wire control system of a ship according to claim 12, wherein the end of the Bowden cable (16), remote from the rotor, is connected to a shaft in a rotationally fixed manner by an adaptor device which is connected in a rotationally fixed manner to the rudder, so that the Bowden cable (16) is actuated by actuating the rudder.

15. A method for operating a steering actuator being a linear electro-mechanical actuator and comprising an electric motor (2), a controller (11) connected via a CAN bus to an electronic control unit of the control system (ECU) of the ship, and an angle sensor (12) connected to the controller (11) for determining an angular position of the rudder (13), the electric motor (2) being a vector-controlled brushless motor, the method comprising the steps of:

checking a functionality of the CAN bus by sending, from the electronic control unit of the control system (ECU) to the controller (11), a defined signal at specified time intervals, and if the defined signal is received by the controller (11) without an error within a specified time interval, continuing operation of the steering actuator; and if the defined signal is either not received or is received erroneously by the controller (11), adjusting the rudder (13) to a null position, maintaining the rudder (13) in the null position and emitting an error message.

16. The method for operating a steering actuator according to claim 15, further comprising the steps of if the defined signal has not been received by the controller (11) within the specified time interval or has been received erroneously, requesting, with the controller (11), that the defined signal be resent to the controller (11) from the electronic control unit of the control system (ECU);

repeatedly requesting that the defined signal be resent a specified whole number of times, with the whole number being between 2 and 50; and adjusting the rudder (13) to the null position with the controller (11), maintaining the rudder in the null position, and emitting an error message, if the defined signal has either not been received within the specified time interval or has been received erroneously, after the specified whole number of repeated requests.

17. The method for operating a steering actuator according to claim 15, further comprising the steps of:

determining the null position when the control system is started up and the angle sensor (12) is an incremental emitter by operating the electric motor (2) at a specified speed in a first steering direction until a first end position of the rudder (13) is reached and storing the sensor value for the first end position in the controller (11);

operating the electric motor (2) at a specified speed in a second steering direction until a second end position of the rudder (13) is reached and storing the sensor value for the second end position in the controller (11);

determining the null position with reference to a number of increments between sensor values for the first and the second end positions and actuating the electric motor (2) to adjust the rudder (13) to the determined null position.

18. The method for operating a steering actuator according to claim 17, further comprising the step determining the first and the second end positions by recognizing as end positions, points where current taken up by the electric motor (2) exceeds a specified threshold value.

19. The method for operating a steering actuator according to claim 17, further comprising the step of checking, before determining the null position, whether the connection between the incremental emitter (12) and the controller (11) is functional and whether the CAN is ready to operate, and, if this the connection between the incremental emitter (12) and the controller (11) fails to function, locking the rudder (13) and emitting the error message.

* * * * *